United States Patent [19]

Geisler

[11] Patent Number: 4,570,910

[45] Date of Patent: Feb. 18, 1986

[54] METHOD OF CONSTRUCTING A STEELMAKING LADLE

[75] Inventor: Thomas A. Geisler, Livermore, Calif.

[73] Assignee: National Refractories & Minerals Corporation, Oakland, Calif.

[21] Appl. No.: 663,736

[22] Filed: Nov. 29, 1984

Related U.S. Application Data

[63] Continuation of Ser. No. 472,508, Mar. 7, 1983, abandoned.

[51] Int. Cl.[4] ..... C21B 7/04

[52] U.S. Cl. ..... 266/284; 266/280; 222/591; 106/38.27; 501/111

[58] Field of Search ..... 501/111, 116, 122; 106/38.27; 266/280, 284

[56] References Cited

U.S. PATENT DOCUMENTS 3,304,187 2/1967 Limes et al. ..... 501/111

4,443,259 4/1984 Nooden ..... 501/122

FOREIGN PATENT DOCUMENTS 0019995 12/1980 European Pat. Off. ..... 501/111

1802001 8/1969 Fed. Rep. of Germany ..... 501/111

38-2998 4/1963 Japan ..... 501/122

55-62808 5/1980 Japan ..... 501/122

*Primary Examiner*—William R. Dixon, Jr.

*Assistant Examiner*—Steven Capella

*Attorney, Agent, or Firm*—Malcolm McQuarrie

[57] ABSTRACT

A ladle or other vessel for containing molten metal, for example molten steel, is lined with refractory at least some of which (e.g. in the slag line area) is unfired refractory bonded with a phosphate bond such as a long-chain glassy polyphosphate and containing, at least in the material smaller than 0.15 mm (−100 mesh), a high-lime periclase grain. This type of refractory shows unexpectedly high resistance to erosion and corrosion in the environment of a steelmaking ladle.

6 Claims, No Drawings

METHOD OF CONSTRUCTING A STEELMAKING LADLE

This is a continuation, of application Ser. No. 472,508, filed Mar. 7, 1983 now abandoned.

BACKGROUND OF THE INVENTION

This invention pertains to vessels for containing molten metal, for example steel making ladles, and particularly to the refractory lining for such vessels.

Some years ago it was customary to line steelmaking ladles with refractory brick made from clays which had the characteristic that, at the temperatures encountered in use, the brick expanded or "bloated" so as to wedge themselves within the ladle and close very tightly any joints between the brick. However, one shortcoming of such brick is their relatively low refractoriness.

As the temperatures of molten steel in steelmaking operations have increased in more recent years, and the time of holding metal in a ladle, for example to refne it, has increased, it has become the practice to line the ladles with more refractory brick, for example high alumina brick.

Even more recently it has become the practice to line steelmaking ladles with so-called "basic" brick, that is to say brick made with materials such as periclase and combinations of periclase and chrome ore, particularly when the ladle slag is a basic slag. There are many kinds of such basic refractories, varying in their composition and method of manufacture (e.g., whether chemically bonded or fired).

The term "basic" as used in connection with both refractories and slags refers to their chemical composition. Thus, for example MgO- and CaO-containing compositions, either refractory brick or slag, are considered "basic" because of the chemical nature of these materials, whereas silica, for example, on the other hand, again either in the molten form in slag or in the solid form in refractory brick, is considered an "acid" material. Generally, the chemical nature of these materials is such that one basic material tends to react relatively slowly with another basic material, but will react chemically very rapidly with an acid material.

The refractories in a steelmaking ladle wear mainly by corrosion and erosion, although thermal shock may play a role, and there is a continual search for a refractory which will have a longer life in the ladle, particularly with respect to its cost. In other words, the steelmaker is looking for a refractory that will cost the least number of dollars per ton of steel produced.

As is customary in many refractories applications, it is a frequent practice to use a higher grade of refractory in areas of greater wear. In a steelmaking ladle, this is generally the area known as the "slagline", that is to say the level in the vessel where the slag comes in contact with the refractory lining when the vessel is filled with molten metal. Accordingly, a more erosion/corrosion resistant refractory is sought for this particular area.

The present invention relates to a refractory lining which has proven to be outstandingly resistant to corrosion and erosion by a basic slag in a steelmaking ladle, particularly at the slag line.

BRIEF DESCRIPTION OF THE INVENTION

It has now been found, according to this invention, that superior resistance to molten metal and basic slag attack is obtained in a vessel for containing such molten metal when the vessel is at least partially lined with refractory material containing from 60% to 80% particles larger than 0.15 mm and from 40% to 20% particles smaller than 0.15 mm, the preceding percentages being based on the total weight of refractory material, wherein the refractory material smaller than 0.15 mm contains from 2% to 20% by weight CaO, based on the total amount of refractory material smaller than 0.15 mm, and $SiO_2$ in an amount such that the $CaO/SiO_2$ weight ratio is at least 1.87, the balance of the refractory material smaller than 0.15 mm being MgO plus normal impurities, and wherein the refractory is bonded with a phosphate bond.

DETAILED DESCRIPTION

While the present invention finds principal application in a vessel, such as a ladle, for containing molten steel, it can be applied in other areas where a basic slag is used in contact with refractories. Of course, it can be used in other locations, but then its slag resistance characteristic will not be taken advantage of.

The refractories used to line a ladle according to this invention will commonly be in shaped or brick form, although the invention has application to a monolithic lining such as a cast or gunned or rammed lining. When used in brick form, the refractory may be in the shape of a wedge or tapered brick, but will most commonly be in the so-called "semiuniversal" shape, a shape having concave and convex curved ends of such configuration that the brick can be used to turn the interior of any diameter ladle within a certain range of diameters.

The refractory used in the present invention will be of the basic type, that is it will be made of periclase or a combination of periclase and chrome ore or of other basic raw materials, for example dolomite. While the relatively coarse portion of the refractory, that is, larger than 0.15 mm (+100 mesh), can be of any basic material, it is essential that the refractory material smaller than 0.15 mm have a particular chemical composition.

Specifically, this fine or matrix material will have in addition to MgO and normal impurities, from 2% to 20%, preferably about 10%, CaO and sufficient $SiO_2$ so that the lime/silica weight ratio is at least 1.87. As is known to those skilled in the art, such a refractory will have dicalcium silicate ($2CaO.SiO_2$) as the dominant secondary phase, periclase (MgO) being the primary phase. While the matrix will usually be of a single grain type, it can contain different materials so long as its overall chemistry is as specified.

The other important feature of the refractory used in the present invention is that it is bonded with a phosphate bond, preferably a glassy phosphate, and most particularly a long-chain glassy polyphosphate. It has heretofore been believed that the most resistant refractories were those which were fired, and particularly those which have been fired to a relatively high temperature. Accordingly, it is indeed surprising that, as demonstrated by the examples below, a chemically bonded, unfired refractory shows distinctly superior corrosion and erosion resistance as compared to fired or ceramically bonded refractories.

The phosphate bond imparts good strength to the refractory at intermediate temperatures, for example at temperatures from about 600° to 1000° C. (about 1100° to 1800° F.). While any phosphate bond can be used, when making a brick or other shape, a bonding material is desired which will not set up too rapidly (i.e., set before the maker has a chance to form the material).

Accordingly, for shapes, it is preferred to use glassy polyphosphates, and more particularly long-chain glassy polyphosphates (i.e., chain lengths which average 6 or more phosphorous atoms).

While it is preferred that brick of the present invention be used in unfired or chemically bonded form, primarily because of their better thermal shock resistance and their generally lower cost of production, fired brick of the requisite composition can be used if desired.

In lining a ladle or other vessel for containing molten metal, if bricks are used they will be made in the conventional fashion by pressing, curing, and laying in place to line the ladle, and if a monolithic refractory is used it will be mixed with the requisite tempering liquid and then rammed or cast or gunned into place in the ladle, generally behind a temporary form in the case of ramming and casting.

While the reason for the superior erosion/corrosion resistance of the refractory lining according to this invention is not certain, and it is not wished to be bound to any particular theory, it is believed that the relative low thermal conductivity of the refractory made with high-lime, dicalcium silicate grain, and the relatively high fracture toughness of the resulting refractory contribute to its good resistance to molten steel.

Corrosion is the process whereby a slag or other molten material in contact with the refractory dissolves the matrix material in the refractory, causing it to wear away. Erosion, on the other hand, refers to a process where larger pieces of refractory, for example refractory aggregate, are removed from the refractory (perhaps after the matrix has been removed by corrosion) by the washing action of a molten slag or other material flowing past the refractory surface. The laboratory slag test described below does not distinguish between these two mechanisms of wear, but rather measures an overall rate of wear due to both processes. While both processes may take place in any given practical application, often one or the other predominates and controls the rate of wear. In any case, the laboratory slag test is a general measure of a refractory's resistance to slag attack and generally correlates well with the resistance of the refractory to slag in a practical application such as a ladle containing molten metal with its overlying layer of slag.

EXAMPLES

Table I sets forth several examples of compositions according to this invention, together with several comparison compositions, and their associated properties. (The amounts of the ingredients given in Table I are parts by weight.) The Compositions 1, 3, 5, 9, and 10 are compositions according to the present invention and the other compositions in Table I are comparison examples.

The typical chemical analyses of the various grains used in the compositions of Table I are set forth in Table II. Grain A is a high lime synthetic periclase made by sintering an admixture of magnesium hydroxide produced from sea water with calcium carbonate and silica. Grain B is a naturally occurring Masinloc chrome ore, Grain B' is a Transvaal chrome concentrate, and Grain C is a synthetic periclase, again produced from sea water. Grain D is a prereacted grain made by sintering together magnesium hydroxide from sea water and finely ground chrome ore. Grain E is a calcined bauxite and Grain F is a calcined bauxitic fireclay. Grains G, H, and I, are all high purity (i.e., high MgO) synthetic periclase grains made from either sea water or inland brines.

TABLE I

| Composition | | 1 | 2 | 3 | 4 | 5 | 6 | 7 | 8 | 9 | 10 | 11 | 12 |
|---|---|---|---|---|---|---|---|---|---|---|---|---|---|
| Aggregate | Type | A | C | C | D | D | F | G | D | D | G | H | I |
| | Amount | 50 | 70 | 70 | 70 | 70 | 40 | 63 | 50 | 54 | 70 | 70 | 70 |
| | Type | B | — | — | — | — | — | — | B' | B' | — | — | — |
| | Amount | 20 | — | — | — | — | — | — | 20 | 16 | — | — | — |
| Matrix | Type | A | C | A | D | A | E | G | H | G | G | H | I |
| | Amount | 30 | 30 | 30 | 30 | 30 | 45 | 32 | 30 | 30 | 30 | 30 | 30 |
| Bond | Glass H | 2.5 | 2.5 | 2.5 | 2.5 | 2.5 | — | — | — | 2.5 | 2.5 | 2.5 | 2.5 |
| | Lignosite | — | 1.0 | 1.0 | 1.0 | 1.0 | — | — | 1.5 | — | 1.0 | 1.0 | 1.0 |
| | Clay | — | — | — | — | — | 15 | — | — | — | — | — | — |
| | Coal Tar Pitch | — | — | — | — | — | — | 5 | — | — | — | — | — |
| | Refcon cement | — | — | — | — | — | — | — | — | 1 | — | — | — |
| Erosion (in/hr) | | 0.000 | 0.063 | 0.031 | 0.040 | 0.000 | 0.388 | 0.119 | 0.056 | 0.009 | 0.000 | 0.000 | 0.000 |
| Density[a] (pcf) | | 186 | 182 | 182 | 192 | 191 | 161 | 193 | 200 | 196 | 188 | 185 | 184 |
| MOR, 1260° C. (psi) | | 1795 | 215 | 260 | 620 | 695 | 880 | — | 500[b] | 1635 | 2005 | 210 | 210 |

[a]dried at 150° C.
[b]at 1482° C.

TABLE II

| Grain | MgO | CaO | $SiO_2$ | $Al_2O_3$ | $Cr_2O_3$ | $Fe_2O_3$ | $TiO_2$ | $B_2O_3$ | Alk |
|---|---|---|---|---|---|---|---|---|---|
| A | 78.1 | 11.0 | 3.3 | 1.6 | 1.6 | 3.8 | — | 0.6 | — |
| B | 21.4 | 0.7 | 5.8 | 27.7 | 30.4 | 14.0 | — | — | — |
| B' | 11.0 | 0.1 | 0.6 | 14.7 | 45.1 | 28.5 | — | — | — |
| C | 95.4 | 1.0 | 2.1 | 0.4 | 0.4 | 0.6 | — | 0.2 | — |
| D | 61.4 | 0.7 | 1.5 | 14.2 | 15.1 | 7.1 | — | — | — |
| E | 0.3 | 0.2 | 6.6 | 87.3 | — | 1.6 | 3.6 | — | 0.3 |
| F | 0.4 | 0.2 | 33.4 | 61.8 | — | 1.4 | 2.6 | — | 0.2 |
| G | 96.2 | 2.3 | 0.7 | 0.2 | — | 0.5 | — | 0.1 | — |
| H | 98.1 | 0.9 | 0.4 | 0.1 | 0.2 | 0.3 | — | 0.1 | — |
| I | 98.3 | 0.6 | 0.5 | 0.2 | — | 0.3 | — | 0.1 | — |

Glass H is a long chain glassy polyphosphate with an average chain length of about 21 phosphorous atoms manufactured by FMC Corporation. Refcon is a medium purity calcium aluminate cement manufactured by *Lehigh Cement Company.* The clay used in Composition 6 was a ball clay containing about 30% $Al_2O_3$. Lignosite is a lignosulfonate binder manufactured by Georgia-Pacific.

The compositions of Table I were sized according to well-known practice in the industry to obtain good packing and consequent high density. For purposes of explaining the present invention, the different-sized grains used in these compositions are divided, somewhat arbitrarily, into "aggregate", grain larger than 0.15 mm (plus 100 mesh), and "matrix", grain smaller than 0.15 mm.

The brick of Composition 1 have been used extensively to line molten metal ladles, particularly at the slag line. For this application, probably the most significant laboratory test is one for wear of the various compositions by molten slag. In this test, pressed brick specimens 4½ inches square (11.5×11.5 cm) have a 2.5 inch (6.4 cm) diameter hole drilled in the center and a column of 5 such specimens is assembled to form a hollow cylinder which is rotated at 2.5 rpm about an axis about 3° above the horizontal and heated to a temperature of 1650° C. (3000° F.), while 155 gram bars of a synthetic slag are fed into the rotating assembly once every five minutes until a total of 20 bars have been fed to the assembly, melted therein, and flowed out the lower end. Accordingly, the complete test on a single assembly of one composition takes one hour and forty minutes. The composition of the synthetic slag used was: 54.4% CaO, 18.0% $SiO_2$, 10.0% $Al_2O_3$, 6.3% MgO, 5.5% MnO, 3.4% $F_2$, 2.2% $Fe_2O_3$, and 0.2% S. The erosion rate is given in inches per hour. Other properties in Table I are in pounds per cubic foot (pcf) and pounds per square inch (psi); MOR stands for Modulus of Rupture.

It can be seen that Composition 1, the composition which had proved exceedingly effective in actual use in steel plant ladles, showed zero wear in this test. Composition 6 is an aluminosilicate composition which is a standard high alumina brick used to line ladles containing molten steel, it can be seen that its rate of erosion is relatively high. Since it was a relatively inexpensive brick, it was desired to find a brick which was not greatly more expensive, but which would show much less wear. Composition 7 is a tarbonded periclase brick which has been tried in ladles; as can be seen, its erosion rate is less than one-third that of the aluminosilicate brick, but far from zero. Note, however, that Composition 10, made with the same grain as Composition 7 but bonded with Glass H, showed zero corrosion. It is believed this is because Grain G has the chemical composition specified for the matrix of a brick according to this invention.

Another line of approach to solving this problem was to try various high fired periclase-chrome brick. Composition 8 is typical of the results obtained with such brick. As can be seen, its wear rate was less than that of the tarbonded brick. While the low erosion rate of Composition 8 is desirable, the price of this brick is much higher than is desired for this application.

As has already been indicated, brick of the present invention, for example Composition 1, which is made of relatively inexpensive raw materials, show very low or zero wear in the standard test. Compositions 11 and 12 also show zero wear rate in the standard test, but these are made from extra high purity periclase and are relatively expensive brick. In other words, the relatively low cost brick of the present invention gives results in this application equal to those produced by much more expensive brick.

Compositions 3 and 5, to be compared with Compositions 2 and 4, respectively, show that it is the presence of high lime grain, for example Grain A, in the matrix portion of the composition which leads to the excellent erosion results obtained with compositions of this invention. Thus, brick made entirely with Grain C, an intermediate purity synthetic periclase, show low but substantial wear, whereas replacing the matrix or ball mill fine material of Composition 2 with fine Grain A in Composition 3 reduces the wear by half. This same effect is shown in Compositions 4 and 5, Composition 4 being made with a prereacted synthetic periclase-chrome grain.

Composition 9 is an example of the practice of this invention near the extreme limits. The aggregate in Composition 9 was prereacted Grain D together with Grain B', a Transvaal chrome concentrate. Although this chrome concentrate is considered to be aggregate, in fact about one-fifth of it fell below 0.15 mm (-100 mesh) in size. The matrix was Grain G which contains relatively low amounts of lime and silica, but in a ratio to produce dicalcium silicate. In addition, Composition 9 contained Refcon cement, which contributed further lime, and a lesser amount of silica, to produce a matrix having a composition within the scope of this invention. However, as can be seen by Table I, the wear of Composition 9, while relatively low, was not as low as that of preferred Composition 1.

I claim:

1. A method of constructing a steelmaking ladle by lining at least the slagline portion of the ladle with basic refractory material containing from 60% to 80% particles larger than 0.15 mm and from 40% to 20% particles smaller than 0.15 mm, the preceding percentages being based on the total weight of refractory material, the refractory material smaller than 0.15 mm containing from 2% to 20% by weight CaO, based on the total amount of refractory material smaller than 0.15 mm, and $SiO_2$ in an amount such that the $CaO/SiO_2$ weight ratio is at least 1.87, the balance of the refractory material smaller than 0.15 mm being MgO plus normal impurities, the refractory being bonded with a phosphate bond.

2. The method according to claim 1 wherein the bond is a glassy phosphate.

3. The method according to claim 2 wherein the bond is a long-chain polyphosphate.

4. The method according to claim 1 wherein all the basic refractory material contains from 2% to 20% by weight CaO and $SiO_2$ in an amount such that the $CaO/SiO_2$ weight ratio is at least 1.87, the balance of the refractory material being MgO plus normal impurities.

5. The method according to claim 4 wherein the bond is a glassy phosphate.

6. The method according to claim 5 wherein the bond is a long-chain polyphosphate.

* * * * *